United States Patent [19]

Koering

[11] 4,192,331

[45] Mar. 11, 1980

[54] ELECTROPLATING APPARATUS

[76] Inventor: Dale, J. Koering, 1697 Laurel Ave., Saint Paul, Minn. 55104

[21] Appl. No.: 937,060

[22] Filed: Aug. 28, 1978

[51] Int. Cl.[2] ..... B08B 3/02

[52] U.S. Cl. ..... 134/77; 134/104; 134/105; 134/109; 204/274

[58] Field of Search ..... 134/60, 76–78, 134/104–105, 109, 199; 204/274

[56] References Cited

U.S. PATENT DOCUMENTS

| | | | |
|---|---|---|---|
| 838,717 | 12/1906 | Hutchinson | 204/45 R X |
| 1,266,167 | 5/1918 | Sears | 134/76 X |
| 1,871,339 | 8/1932 | Pearson | 134/77 X |
| 2,544,644 | 3/1951 | Allen | 134/76 X |
| 2,650,600 | 9/1953 | Davis | 134/77 |
| 2,820,754 | 1/1958 | Brower | 204/202 |
| 2,921,008 | 1/1960 | Hauck et al. | 204/203 |
| 3,039,432 | 6/1962 | Le Boutillier et al. | 134/76 X |
| 3,074,417 | 1/1963 | Lisowski et al. | 134/76 |
| 3,133,007 | 5/1964 | Creese et al. | 204/198 |
| 3,222,269 | 12/1965 | Stanton | 204/274 X |
| 3,278,409 | 10/1966 | Barringer et al. | 204/198 |
| 3,598,131 | 8/1971 | Weihe, Jr. | 134/109 X |
| 3,699,983 | 10/1972 | Morley | 134/76 |
| 3,734,108 | 5/1973 | Almegard et al. | 134/76 |
| 3,789,860 | 2/1974 | Katterheinrich et al. | 134/104 |
| 3,887,094 | 6/1975 | Ikeda et al. | 134/104 X |
| 4,135,530 | 1/1979 | Cheney | 134/60 |

*Primary Examiner*—Robert L. Bleutge
*Attorney, Agent, or Firm*—Merchant, Gould, Smith, Edell, Welter & Schmidt

[57] ABSTRACT

An improved electroplating apparatus comprises a non-linear array of treating tanks having a central rinse tank. A hoist motor is located on a fixed support structure above the rinse tank. A traversing guide engages a hoist cable to move the cable around the array of treating tanks. An insulating canopy surrounds the array to conserve waste heat given off by any heated treating tanks. A plurality of shower nozzles is located around the rinse tank for rinsing off any articles carried thereto by the hoist cable. The rinse water is heated by the waste heat conserved by the insulating canopy. The rinse discharge from the rinse tank can be conducted to a concentrating device for concentrating any contaminants contained in the rinse discharge.

20 Claims, 10 Drawing Figures

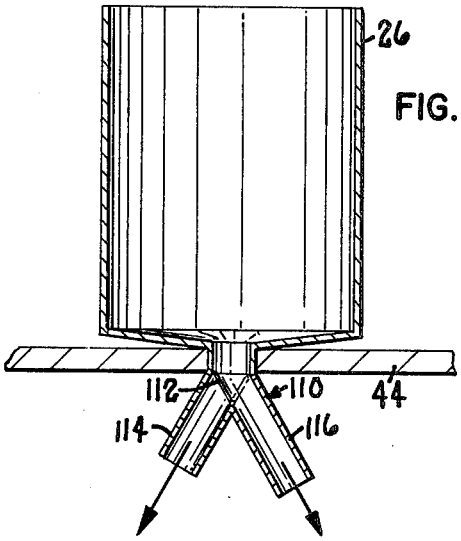
FIG. 6
FIG. 5
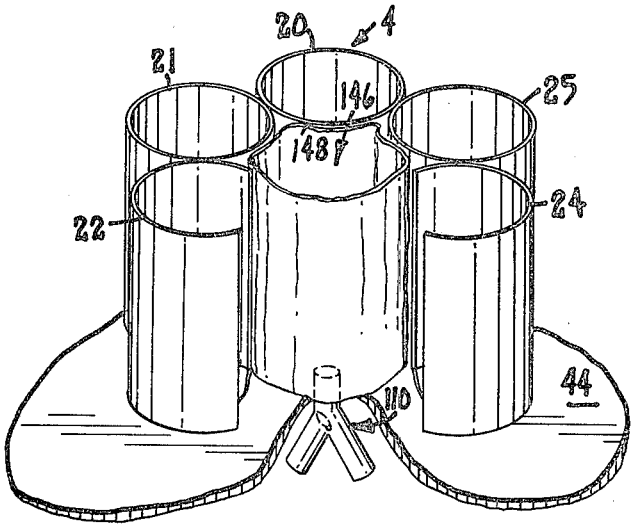
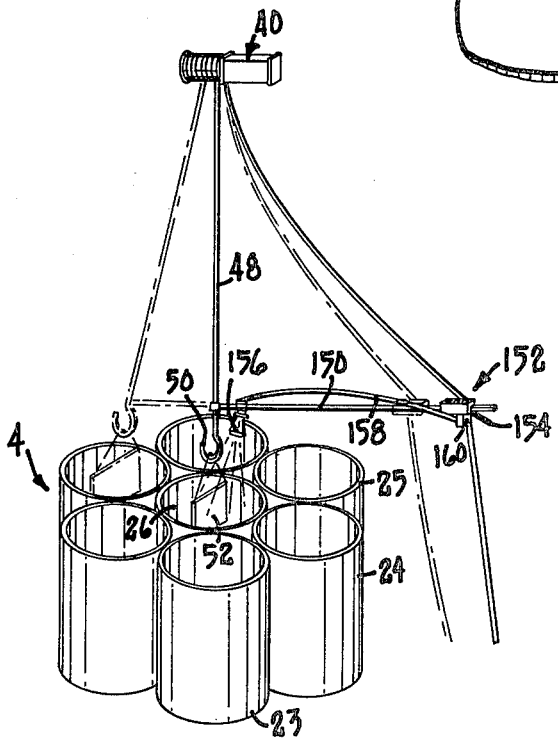
FIG. 8
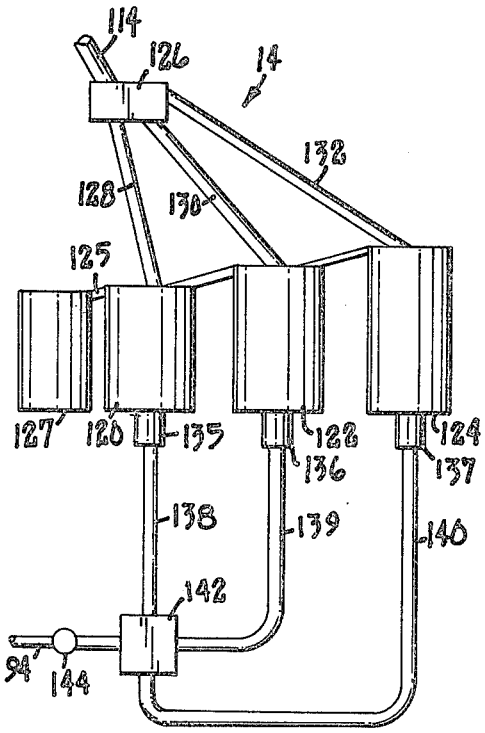
FIG. 7

ELECTROPLATING APPARATUS

BACKGROUND OF THE INVENTION

1. Field of the Invention

This invention relates to an improved apparatus for conducting electroplating operations.

2. Description of the Prior Art

Electroplating is the electrodeposition of an adherent metallic coating upon an electrode for the purpose of securing a surface on the electrode having properties or dimensions different from those of the base metal. As such electroplating is a surface treatment. It has for its purpose the alteration of the surface properties of the work being treated, which is made the cathode in an electroplating solution or bath. Such baths are almost always aqueous solutions so that the metals which can be deposited are limited generally to those which are capable of being discharged from aqueous solutions of their salts.

It is usual to classify electroplating operations according to the principle functions of the deposited plate. Thus, the plating may be applied mainly for (1) appearance; (2) protection; (3) special surface properties; or (4) engineering or mechanical properties. These distinctions are not clear cut. A purely decorative plate may also to some extent at least serve to protect the base metal. One well known electroplating operation is the deposition of chromium or a chrome alloy on automobile parts, such as bumpers, to give a lustrous and shiny appearance. Not only does the chromium serve this decorative function but it also serves to protect the base metal of the part as well.

In conventional electroplating operations, the articles to be treated are usually first cleaned of undesirable surface deposits. This usually comprises dipping or soaking the articles in various types of cleaners and acids. After the article has been properly cleaned, the actual plate is applied by suspending the article in a plating tank having an appropriate aqueous solution therein. Temperature control is almost always desirable in the actual plating operation, because the characteristics of the plating solutions, of the final plating deposits, or of both usually depend to a large extent on the temperature of operation. Thus, many of the actual plating tanks have heating coils therein to maintain the temperature of the plating composition at a pre-determined ideal temperature. An important step in the operation involves thorough rinsing of the articles being treated. Adequate rinsing between all the steps in both the cleaning and the plating operations is usually of the utmost importance. It is known that hot water rinse is more efficient than cold.

It has been customary in prior electroplating systems that a linear arrangement of tanks be provided. In other words, the tanks containing the various cleaner and plating solutions have generally been arranged in a straight line. A work rack or the like then traverses the line from one end to the other with the work rack being dipped into each of the tanks. In such linear arrangements, one or more rinse tanks are located between each of the treating tanks to rinse the articles being treated as they pass down the line. Usually, these rinse tanks simply comprise a tank containing a large body of water in which the articles are dipped. Sometimes, the rinse tanks comprise a series of tanks which consecutively feed water into one another in a so-called cascade or counter-current arrangement. U.S. Patent No. 838,717 to Hutchinson shows a cascade rinse arrangement in which the rinse tanks are located between two adjacent rows of plating tanks A. U.S. Pat. No. 2,921,008 to Hauck et al discloses a conventional linear tank arrangement in a electroplating configuration. Barringer in U.S. Pat. No. 3,278,409 discloses a generally similar arrangement.

One problem with prior art linear tank arrays is the large number of rinse tanks which are required. This increases both the cost of providing suitable tanks and the amount of floor space needed for the electroplating apparatus. It further increases the amount of water needed to rinse the components. In addition, in a linear array, the speed of the articles moving down the line is often limited to the speed at which the slowest articles are moved. Thus, although some articles being treated in the line may not require lengthy immersion in each bath, other articles might require a lengthy immersion which correspondingly is imposed on all the articles in the line.

Another disadvantage with most prior art electroplating apparatuses is that relatively complex machinery is needed to lift and move the articles being treated between the treating tanks. For example, Ikeda, U.S. Pat. No. 3,887,094, discloses a trolley which can traverse over a rectangular array of tanks. However, the components comprising the trolley have to be quite strong, and thus expensive, because the hoisting apparatus for the work racks is also carried on the trolley. Thus, the trolley must be able to carry not only the weight of the work racks but also the weight of all the equipment associated therewith for hoisting the racks between an upper and lower position. Similarly, U.S. Pat. No. 3,699,983 to Morely discloses a traversable trolley or carriage device for moving up and down a linear array of tanks. Again, the hoisting apparatus for the work rack is carried on the trolley itself.

The Morley patent noted above attempts to do away with numerous rinse tanks by replacing all these tanks with a single rinsing zone. This rinsing zone is located at one end of a conventional linear tank array. Whenever it is necessary to rinse the article being treated, Morley discloses taking that article to the rinsing zone and submerging that article therein. Alternatively, Morley discloses showering the articles off in the rinsing zone. Similarly, the patent to Almegard, U.S. Pat. No. 3,734,108, attempts to do away with the many sprays or rinse tanks in a conventional linear arrangement by having a movable spray booth mounted above the treating tanks. This movable spray booth is moved to a position above the tanks containing the articles being treated. When it is desired to rinse these articles off, the articles are raised into the spray booth where they are rinsed off by a liquid spray.

Although Morley and Almegard alleviate somewhat the space problem occasioned by numerous in line rinse tanks, they have certain disadvantages. The apparatus of Almegard is extremely complex. This complexity makes it expensive which renders it somewhat impractical for use on a small scale. Similarly, although Morley used only a single rinsing zone, his rinsing zone is located at one end of an in line tank arrangement. To reach that particular rinse location, it is necessary to traverse the entire line when the article is located at the other end. This is time-consuming if the line is lengthy.

SUMMARY OF THE INVENTION

One aspect of the present invention is an improved electroplating apparatus which is simple, relatively inexpensive, and particularly adaptable to small scale operations.

More particularly, the electroplating apparatus according to this invention comprises a non-linear tank array having a central rinse tank or rinsing zone located near the center thereof. A plurality of shower heads are located around the rinsing zone for spray rinsing any articles positioned in the rinsing zone. A hoist located on the ceiling or other fixed support structure is located generally centrally above the rinsing zone. The hoist cable passes through a traversable guide and terminates in a means for releasably coupling the articles being treated. The traversable guide enables the hoist cable to reach any of the treating tanks in the array therefor. An insulating canopy surrounds the tank array to conserve waste heat from those treating tanks which may be heated. The rinse water for the shower rinse is heated by this waste heat by means of a water coil contained inside the canopy. In addition, the discharge from the rinsing zone may be selectively coupled to a concentrator. The concentrator has a novel form for concentrating any contaminants contained in the rinse discharge.

BRIEF DESCRIPTION OF THE DRAWINGS

This invention will be described hereafter in the following Detailed Description, when taken in conjunction with the following drawings, in which like reference numerals refer to like elements throughout.

FIG. 5 is a perspective view of a second embodiment of a rinse tank as used in the electroplating apparatus of FIG. 1;

FIG. 6 is a side elevational view of the rinse tank for the electroplating apparatus of FIG. 1, particularly illustrating the drain means and a valve therefor;

FIG. 7 is a schematic view of a concentrator used in conjunction with the rinse discharge of the electroplating apparatus of FIG. 1;

FIG. 8 is a perspective view of a second embodiment of an electroplating apparatus according to the present invention, the embodiment of FIG. 8 being particularly adapted for manual operation;

DETAILED DESCRIPTION

Figure 1:
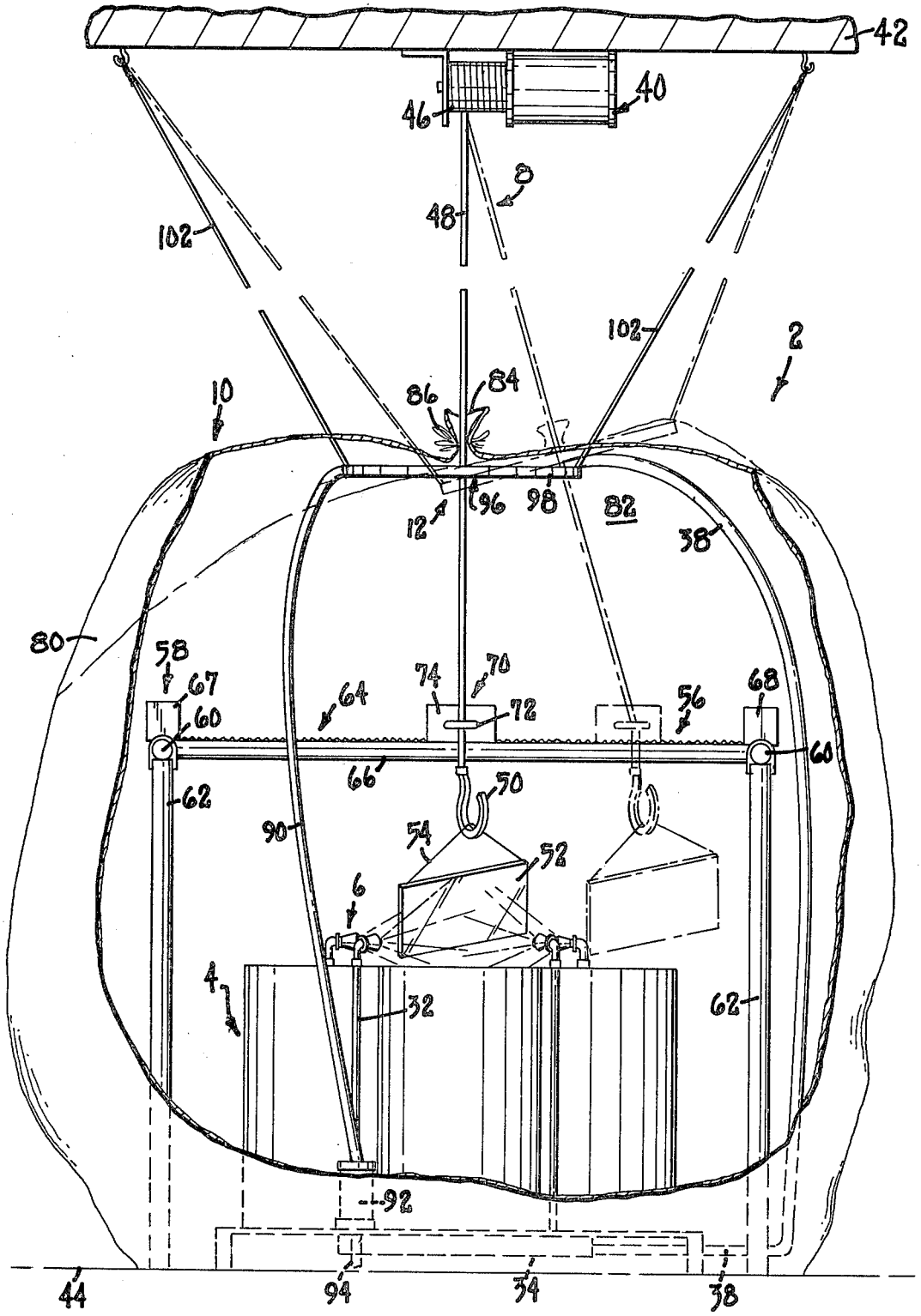
FIG. 1 is a side elevational view of an electroplating apparatus according to the present invention, with a portion of the insulating canopy thereof broken away to illustrate the interior components of the apparatus.

Referring first to FIG. 1, an improved electroplating apparatus according to this invention is generally indicated as 2. Electroplating apparatus 2 includes a plurality of interrelated components generally as follows:

(1) a non-linear array of treating tanks generally indicated as 4;

(2) means 6 for spray or shower rinsing the articles being treated in the array 4 of treating tanks;

(3) means for moving an article, or a work rack which carries a plurality of articles, between the respective treating tanks in the array 4, the moving means being generally indicated as 8;

(4) means for conserving waste heat given off by the treating tanks in array 4 generally indicated as 10; and (5) means for heating a cleaning liquid or rinse water which will be sprayed through rinsing means 6, the heating means being generally indicated as 12.

In addition, the improved electroplating apparatus according to this invention includes a means for concentrating contaminants which are contained in the discharge of the rinsing means 6. This concentrating means is generally indicated as 14 in FIG. 7 and will be described in detail hereafter.

Tank Array

Figure 2:
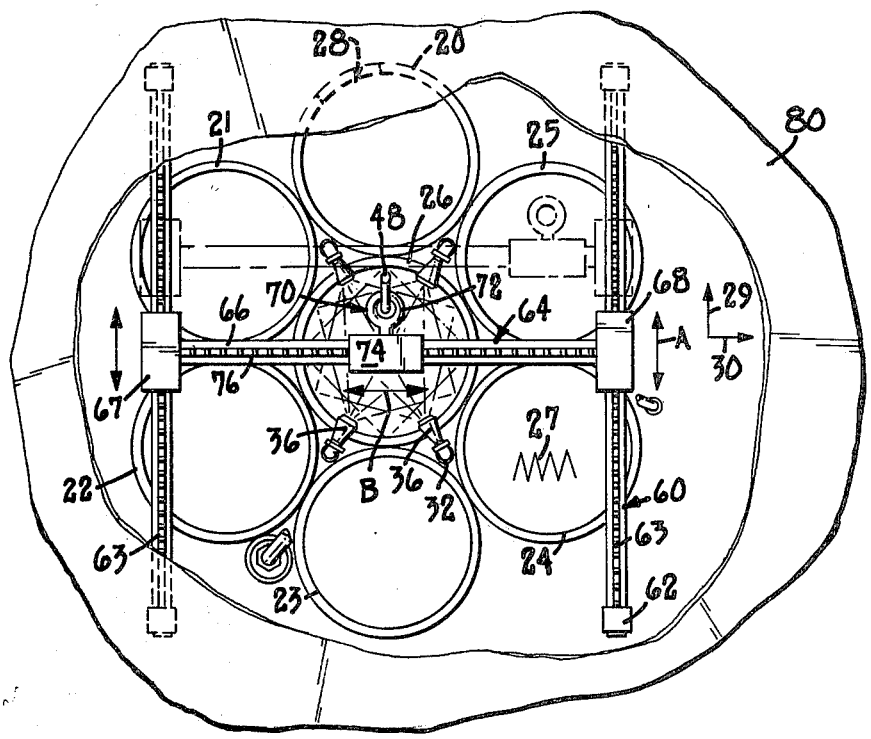
FIG. 2 is a top view of the electroplating apparatus as shown in FIG. 1, with a portion of the insulating canopy thereof broken away to illustrate interior components.

Referring now to FIGS. 1 and 2, tank array 4 preferably comprises a circular array of closely spaced treating tanks. The treating tanks are respectively labelled 20–26. Tanks 20–25 are generally arranged in an outer circle and contact and surround a central rinse tank 26. The treating tanks 20–26 are themselves circular and comprise 55 gallon drums or the like. However, the shape of tanks 20–26 is unimportant and may obviously vary from the circular shape shown. In addition, the tanks 20–25 need not themselves comprise separate tanks. For example, one large tank could be provided with the separate treating tanks 20–26 being formed by a plurality of inner partitions or dividers in the tank. Thus, the present invention is not to be limited to the particular type of tanks shown herein.

The tanks 20–26 are used in a generally conventional manner in an electroplating operation. For example, tank 20 can have a portion of its side cut away to form an entrance generally indicated as 28. The articles being treated by apparatus 2 can be loaded or unloaded into the array 4 through this opening 28. Thus, tank 20 does not contain any aqueous solutions but only serves as a means for attaching the articles being treated to the moving means 8. The remaining tanks 21–25 can then contain various conventional solutions contained in an electroplating operation. For example, tank 21 can contain a soak cleaner, tank 22 an electro cleaner, and tank 23 an acid cleaner. Collectively then tanks 21–23 serve as a means for cleaning the articles being electroplated and for removing undesirable surface deposits therefrom. Tank 24 can comprise a plating tank having an aqueous plating solution therein. Tank 25 can contain a solution with various chromates for further use in the electroplating process. Collectively then tanks 24 and 25 are those tanks in which the adherent metal is deposited on the articles being vended. Tanks 24 and 25 will have the articles immersed therein formed as an electrode in an electrical circuit—this is the conventional means for electroplating the articles being treated with an adherent metal. Any of the tanks 21–25 can also have the solutions contained therein heated by any appropriate heating means. For example, heaters 27 could be positioned in some of the tanks 21–25 themselves or the solutions therein could be continuously circulated through an external heating means.

The circular array 4 of tanks shown in FIG. 2 has a first longitudinal direction 29 and a second transverse direction 30. It can be appreciated that array 4 is quite compact with the use of only a single central rinse tank 26. This rinse tank is used to rinse the articles being electroplated between the various steps of the cleaning or plating processes. The use of a single central rinse tank 26 is advantageous in this type of array because the array can be easily expanded around the rinse tank 26. In other words, to expand the capacity of electroplating apparatus 2, it would only be necessary to add consecutive rings of additional treating tanks around the tanks 20–25. Although the circular array shown in FIG. 2 is preferred, other shapes for the array 4 are also contemplated. Any non-linear tank array could be used in which at least one of the tanks therein comprises a single rinse tank. For example, non-linear array 4 could comprise a rectangular array in which the central tank thereof comprises a rinse tank.

Shower Rinsing Means

Figure 4:
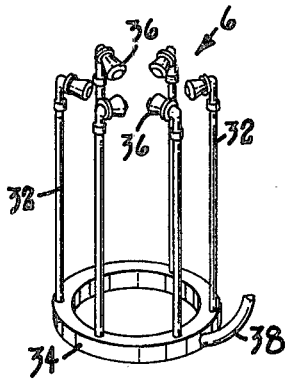
FIG. 4 is a perspective view of a shower rinse array used in the electroplating apparatus of FIG. 1.

Referring now to FIGS. 1, 2 and 4, shower rinsing means 6 comprises a plurality of upwardly extending rinse pipes 32. As shown in FIGS. 1 and 2, rinse pipes 32 are spaced at equal distances around the outer periphery of rinse tank 26 and can be generally located in the gaps between rinse tank 26 and the other treating tanks 20–25. Rinse pipes 32 are connected at their lower end by a circular supply manifold 34. Each rinse pipe 32 includes an inwardly extending shower or spraying nozzle 36 at its upper end. Nozzles 36 are arranged as shown in FIG. 2 to give an overlapping spray pattern in the interior of the rinse tank 26. Nozzles 36 are supplied with a cleaning liquid, usually ordinary water, by means of a supply line 38 connected to manifold 34. Manifold 34 is shown herein as being located below the level of the treating tanks 20–26. However, manifold 34 could be located at any appropriate spot or, alternatively, each of the rinse pipes 32 could have an individual water supply line.

Article Moving Means

The moving means 8 depicted in FIGS. 1 and 2 is for the purpose of physically transferring the article or articles being treated from one treating tank to another in the array 4. Moving means 8 comprises a hoist apparatus such as a conventional hoist motor generally indicated as 40. Hoist motor 40 is fixedly located on the ceiling 42 of a building or other structure in which electroplating apparatus 2 is contained. Referring to FIG. 1, the array 4 of treating tanks may be located on the floor 44 of the same building, or in suitable instances, the array of treating tanks could be recessed into floor 44. Preferably, hoist motor 40 is located on ceiling 42 immediately above the central rinse tank 46. Although it is preferred that hoist motor 40 be fixedly mounted on the ceiling 42, there may be insufficient ceiling height in the building in which electroplating apparatus 2 is to be contained. In such an event, hoist motor 40 could be located on a suitable support structure outside on the roof of the building with the hoist cable thereof passing downwardly through a hole in the roof to the electroplating tanks 20–26.

Hoist motor 40 has a drum 46 on which the hoist cable 48 is wound. Hoist cable 48 passes downwardly from drum 46 and terminates in its lower end in an upwardly facing hook 50. Hook 50 forms a releasable connection with an article being treated. The article being treated is generally indicated as 52. As shown in FIG. 1, hook 50 simply slips or hooks underneath any elongated rope, chain, or other member 54 which is connected to the planar article 52 being treated. As noted previously, the loading of hook 50 with articles to be treated can initially be accomplished in tank 20. Hook 50 could also engage with any type of eye which is provided on the article being treated.

Instead of a planar article 52 hook 50 could engage a suitable work rack. Such a work rack would have a plurality of individual hooks thereon on which separate articles being treated could be hung. In addition, almost any type of conventional releasable connection could be used in place of the hook 50. For example, the lower end of hoist cable 48 could have a tong like structure. Such tongs when lifted have opposed grasping members which come together ever more tightly depending upon the amount of force exerted on the cable 48. A solenoid release mechanism could be provided for opening the tongs when it is desired to release the article being carried or to place the tongs in an open orientation prior to picking up such an article. Thus, hook 50 does not form an important feature of the present invention. All that is required is that some type of releasable connection exist between the end of hoist cable 48 and the articles or work racks being carried thereby.

Hoist motor 40 enables the articles 52 to be vertically moved up and down. However, because hoist motor 52 is fixedly mounted on ceiling 42, it is not itself able to traverse the entire array 4 of the treating tanks which are elongated in two directions 29 and 30. In order to move the articles over this array, a means for traversing the hoist cable 48 in the two directions 29 and 30 is provided. A first embodiment of the traversing means is generally indicated as 56 in FIGS. 1 and 2.

Traversing means 56 includes an elongated guide 58 which spans the length of the treating tanks in the direction 29. The guide 58 comprises two transversely spaced, longitudinally extending rails 60. Rails 60 are located adjacent each side of array 4 and are supported above the level of treating tanks 20–26 by fixed posts 62 at either end of the rails 60. Thus, rails 60 comprise an overhead track system on which a movable carriage 64 is mounted. The top surface of each rail 60 has a longitudinally extending rack 63 thereon. Rack 63 suitable engages with the movable carriage 64 in a manner to be described hereafter.

Carriage 64 includes an elongated cross beam member 66 having opposed first and second ends 67 and 68. The ends 67 and 68 of cross beam member 66 are movably supported on the racks 63 on rails 60 as by a rack and pinion engagement with each rack. At least one of the end portions 67 and 68 includes an integrally contained reversible drive motor (not shown). This drive motor drives the pinion on that end portion in engagement with rack 63 to propel the carriage 64 in a reciprocal direction along the rails as shown by the arrow A.

The cross beam member 64 includes a hoist cable guide assembly which is generally indicated as 70. Cable guide assembly 70 includes an outwardly extending horizontal ring 72. Cable guide assembly 70 further includes a drive motor 74 having a pinion (not shown) which engages with a rack 76 on top of cross beam member 66. By virtue of the engagement of drive motor 74 with rack 76, the cable guide assembly 70 can be traversed back and forth along cross beam member 66. This traversing of the guide assembly 70 occurs in the transverse direction 30 as generally shown by the arrow B in FIG. 2. Hoist cable 48 passes downwardly from the hoist motor 40 and through the center of the ring 72. By virtue of the apparatus shown in FIGS. 1 and 2, the hoist cable 48 can be traversed in the directions 29 and 30 over the array 4 of tanks in a manner to be described hereafter.

Waste Heat Conserving Means

Referring now to FIGS. 1 and 2, at least some of the treating tanks 20-25 have electrical coil tank heaters generally indicated as 27. Tank heaters 27 maintain the temperature of the solution in the treating tanks within pre-determined limits to ensure that the electroplating process takes place properly. As shown in FIG. 1, means 10 for conserving the waste heat given off by the treating tanks and their tank heaters is employed surrounding the array 4. Conserving means 10 comprises a flexible and generally hemispherical bag or canopy 80. Canopy 80 may be made of any suitably flexible material which is resistant to the passage of heat. For example, canopy 80 can be made of a strong heat insulating foam rubber sheeting (e.g., ½" thick). However, canopy 80 can be made of any other suitable heat insulating material.

As shown in FIG. 1, canopy 80 completely surrounds the non-linear array 4 of treating tanks and also encloses the traversing means 56 for the hoist cable 48. The top end of canopy 80 has an opening 84 through which the hoist cable 48 is allowed to pass. If so desired, canopy 80 can be fastened about the cable 84 by means of a suitable fastener, such as a rope or cable 86. Canopy 80 is, of course, completely flexible. As the hoist cable 48 moves up and down and traverses from one side of array 4 to the other, movement will occur in the canopy 80 generally corresponding to these movements of hoist cable 48. In other words, canopy 80 does not restrain hoist cable 48 from making the necessary movements. If desired, canopy 80 can be secured with some slack or loosely draped at its lower end to the floor 44 of the structure in which electroplating apparatus 2 is contained. Canopy 80 is caused to retain a balloon-type shape defining an open upper chamber 82 above array 4. This chamber can be maintained because canopy 80 can either be formed such that it naturally tends to assume a balloon or a positive source of air pressure can be blown in underneath the canopy to inflate the canopy to the shape generally shown in FIG. 1.

Applicant contemplates that canopy 80 will be an effective means for containing the waste heat given off by the tank heaters 27. More particularly, it is expected that the temperature inside chamber 82 can rise to 100° F. or more when the tank heaters 27 are typically energized to 175° F. Canopy 80 serves the function of containing the heat given off by these tanks at a location surrounding array 4 such that the remainder of the building outside of canopy 80 can be maintained at much lower temperature. Thus, workmen who attend to the electroplating apparatus 2 are not subjected to unduly high or uncomfortable heat. Canopy 80 can also be made to resist passage of possibly harmful vapors or fumes given off by the treating tanks. In this regard, canopy 80 also serves to protect the atmosphere which workers inside the building breathe.

Cleaning Liquid Heating Means

It has been found that the most effective rinsing occurs when the cleaning liquid, typically water, is heated. However, it is expensive to use a continuously operated external heating source for heating this water. Thus, to the best of Applicant's knowledge, most prior art rinsing operations have been conducted with cold water as a simple matter of economics.

Figure 3:
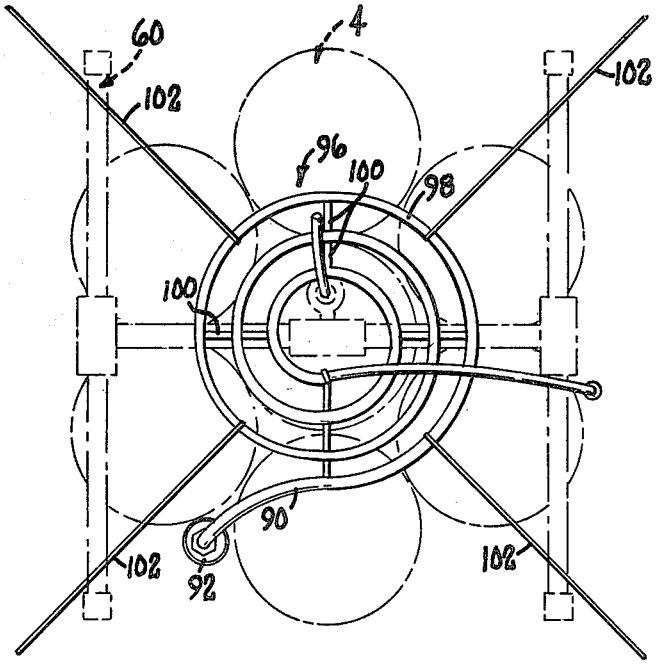
FIG. 3 is a top plan view of the electroplating apparatus as shown in FIG. 1, particularly illustrating a heating coil of the present invention.

Electroplating apparatus 2 according to the present application provides a means 12 for heating the cleaning liquid sprayed by the rinsing means 6. This cleaning liquid is normally ordinary water although other types of liquids could be used. Referring now to FIGS. 1 and 3, the heating means comprises a water supply line generally indicated as 90. Water supply line 90 leads from a pump 92 which is supplied with water from conduit 94 in a manner described hereafter. Pump 92 pumps water through the water supply line 90 upwardly to a spiral heating coil generally indicated as 96. Heating coil 96 is located in the chamber 82 closely adjacent the top of insulating canopy 80. Hoist cable 48 passes downwardly through the center of coil 96.

As shown in FIG. 3, spiral coil 96 can comprise any suitable tubing 98 arranged in a spiral form. Tubing 98 can be spaced apart into the coils and held substantially rigid by spacers 100. Four guide wires or cables 102 lead from the ceiling 42 of the building in which electroplating apparatus is contained. Cables 102 attach to the heating coil 96 at various locations to independently suspend and support the heating coil 96 inside canopy 80. The end of the heating coil opposite to the end connected to the supply line 90 is connected to the water supply conduit 38. Conduits 90 and 38 and the tubing 100 comprising heating coil 96 may be made of any suitable material. Preferably, flexible plastic tubing can be used for all these components with the conduits 90 and 38 arranged to the side of array 4 so as not to interfere with the traversing of hoist cable 48.

Operation of Electroplating Apparatus

In the operation of the electroplating apparatus 2, the various components thereof are placed in the assembled relationship as shown in FIG. 1. Articles 52 to be treated are then loaded onto hoist cables 48 in the loading and unloading tank 20. In this regard, insulating canopy 80 can have a suitable access opening (not shown) to allow personnel to enter canopy 80 where the articles to be treated can be installed on or removed from hoist cable 48. After an article 52 has been loaded on the hook 50 of the hoist cable, the electroplating apparatus begins by first moving the articles 52 through the cleaning tanks 21-23 and then through the plating tanks 24 and 25. More than one article 52 at a time can be moved through array 4 because the first article can be deposited in one of the treating tanks and then suitably disengaged from hook 50 or any other releasable connection on the end of hoist cable 48. Then hook 50 is available for use in moving another article 52 into a different tank.

After each immersion in the tanks 21-25, it is usually necessary that the article 52 being plated be rinsed or cleaned. In this regard, hoist motor 40 will be actuated to lift cable 48 upwardly until the article 52 clears the tanks and then the traversing means 56 will pull the hoist cable 48 to a position above the rinse tank 26. Hoist motor 40 will then be actuated to lower the article 52 being treated into the rinse tank 26. The rinsing means 6 will then be actuated with the pump 92 serving to pump water upwardly through the heating coil 96 and then into manifold 34 for spraying outwardly through the shower nozzles 36 onto the article 52. This rinse water will be heated during its passage through the heating coil 96 because of the heat exchange relationship with the waste heat conserved inside insulating canopy 80. After a suitable period of rinsing, the rinsing means 6 will be shut down and the article 52 moved to the next treating tank.

The present invention is advantageous in that it replaces the many large rinse tanks of prior electroplating operations with a single rinsing tank or zone. Thus, the non-linear array 4 of tanks in the present invention can be compact and small thereby allowing one to use a centralized hoist motor 40 and an insulating canopy 80. The electroplating apparatus 2 of the present invention has a tremendous savings with regard to floor space and also a svaings with regard to the cost in rinse tanks. Furthermore, since hoist motor 30 is now located on the ceiling, only a simple guide means is needed to traverse or pull the cable 48 from one position in array 4 to another. Thus, the traversing means 56 can be engineered to a lesser degree of sophistication and strength than prior art devices in keeping with the lesser requirements imposed on the equipment. This is also a considerable savings over the expensive types of hoist equipment and movable carriages previously used with prior art electroplating devices. Furthermore, insulating canopy 80 of the present invention serves to conserve waste heat from the heated treating tanks. This waste heat is then effectively put to use by means of heating coil 96 to heat the rinse water and thus more effectively rinse the articles 52.

Concentrating Means

Referring now to FIGS. 6 and 7, it is seen that the bottom of the rinse tank 26 is provided with a Y-shaped drain 110. Drain 110 has a valve 112 which can be moved between one of two positions to respectively open or close the various outlet conduits of drain 110. As shown in the solid line position in FIG. 6, valve 112 is in a first position closing outlet conduit 114 and opening outlet conduit 116. Conduit 116 is connected to an ordinary sewer or other waste disposal means. However, outlet conduit 114 is generally connected to the concentrating means 14 shown in FIG. 7. Thus, whenever the discharge from the rinse tank 26 contains contaminants which should for any reason be saved, then valve 112 is actuated to its phantom line position. In this position, the outlet conduit 114 is open and the rinse discharge from rinse tank 26 is conducted to the concentrating means 14.

Concentrating means 14 provides a novel and efficient means for concentrating the contaminants contained in the rinse discharge. Such contaminants often must be saved for various reasons. For example, when electroplating with precious metals, such as gold or silver, it is desired for economic reasons to recover any of the precious metals which have been rinsed off the articles 52 during the treating processes therefor. In addition, certain other contaminants must be removed from the rinse discharge because they are harmful contaminants with regard to the environment. Thus, concentrating means 14 is useful in concentrating either type of contaminants.

Concentrating means 14 is schematically illustrated in FIG. 7. Concentrating means 14 includes three tanks, 120, 122, and 124. A four-way valve generally illustrated as 126 has three conduits 128, 130, and 132 respectively communicating with each one of the tanks. Tanks 120, 122 and 124 are arranged in a conventional cascade fashion as described in U.S. Pat. No. 838,717. The last tank 120 in the cascade is connected by an overflow pipe 125 to a treatment tank 127. The tanks 120, 122, and 124 are each provided with a pump 135, 136, and 137 respectively. These pumps are connected by conduits 138, 139, and 140 to a valve 142. Valve 142 is in turn connected to a water supply line 94 which leads to pump 92. In addition, the four-way valve 126 is connected to the outlet conduit 114 of drain tank 26.

In the operation of concentrating means, assume that a first rinse operation is occurring in rinse tank 26. Any suitable control means, such as an electrical circuit (not shown) having a timer, may be connected to control the components of concentrating means 14. This control means operates the valve 126 to split the rinse discharge coming through conduit 114 from the first rinse operation (and each subsequent rinse operation) into three separate and equal portions. The first portion of the rinse discharge is discharged into conduit 128 and from there into tank 120. The second portion of the rinse discharge is conducted into conduit 130 and from there into tank 122. Similarly, the final remaining portion of the rinse discharge is conducted into conduit 132 and from there to tank 124.

After the first rinse operation, the rinse discharge solution contained in tank 120 will have the most concentrated form of contaminants. The solutions contained in the tanks 122 and 124 will have progressively less concentrated solutions of contaminants since they were obtained progressively later during the rinse operation after the majority of the contaminants on the article were already rinsed off into tank 120. The solution occuring in tank 124 will be nearly pure water. For the first rinse operation, the water being used to rinse the articles 52 would be pure water which can be brought into the supply line 94 through a valve 144.

Assume for the purposes of this discussion that the volume of the rinse water used in the first rinse operation is sufficient to substantially fill all of the tanks 120, 122 and 124 to the point where they are just about overflowing into one another. This may not occur as a practical matter in the first rinse operation. If a plurality of rinse operations are needed in order to accumulate a sufficient amount of solution in each of the tanks 120, 122, and 124, then pure water will be used in all of the initital rinse operations needed to reach this condition. However, once these tanks are sufficiently full, then the rinse water used in future rinse operations will not constitute pure water during the entire rinse operation, but will be drawn in large part from the tanks 120, 122 and 124 as described hereafter.

In the rinse operations where the rinse liquid is drawn from tanks 120, 122, and 124, the pumps 135, 136, and 137 and the valve 142 are suitably activated by the control means (not shown) to pump the rinse solutions contained in the tanks 120, 122, and 124 through the conduits 138, 139, and 140 to form a major portion of the liquid used in rinsing the next article. In this regard, for the first portion of the rinsing cycle corresponding to that portion where the rinse discharge is being directed to the tank 120, the pump 135 and the valve 142 are actuated such that the rinse water itself is coming from the tank 120. For the second portion of the rinse operation, the solution in the tank 122 is used as the source of rinse water with the rinse discharge in that portion also being recirculated back through conduit 130 to the tank 122. For the final third portion of the rinse operation, i.e. that portion where the rinse discharge is directed to tank 124, the rinse solution used in this portion comes from two sources. First, the rinse solution initially comes from tank 124 by suitable activation of pump 137 and valve 142. However, for a given period of time depending on the amount of contamination which has been built up in tank 124, the very last part of the third rinse portion will constitute pure water which will be conducted to the shower through valve 144. Thus, the final segment of the final portion of the rinse operation always constitutes pure water which guarantees a complete rinse of the article. Also, this small addition of water will cause tank 124, which has been substantially filled in previous rinse operations, to overflow slightly into tank 122 which overflows slightly into tank 120, and so on. Tank 120 finally discharges an amount of solution therefrom into treatment tank 127 which is equal to the pure water addition in each rinse operation. The concentrating means 14 can thus be controlled by adding only enough water to keep the rinse water which is contained in storage tank 124 relatively pure.

Thus, it will be seen that a small amount of very concentrated rinse discharge will be discharged into the treatment tank 127 during each rinse operation after the tanks 120, 122 and 124 have initially been filled. The solution held in the treatment tank 127 can then be conducted to a separator. For example, in the case of gold, the solution in the tank 127 could be directed to any suitable device where the gold could be precipitated out of solution and recovered. Concentrating means 14 is also effective for concentrating pollutants. It thus enhances the efficiency of pollution control equipment since the discharge from the treatment tank 127 will have the pollutants located therein contained in a concentrated form. The principles behind the concentrating apparatus are not limited to the number of tanks 120, 122, and 124 shown herein. One could use additional storage tanks and divide the rinse discharge in each rinse operation, and the rinse water used in subsequent operations, into as many portions as there are storage tanks.

Thus, it can be seen that the concentration of contaminants in the solutions in the tanks 120 and 122 will be constantly increased from one rinse cycle to the next. That is because the most concentrated portions of each rinse discharge are always directed to the same tanks and due to the fact that the rinse discharge solutions contained in the tanks become the rinse water for the same corresponding portions of future rinsing cycles. In effect, the tanks 120, 122, and 124 are connected in a feedback arrangement with the shower rinsing means 6 during the rinsing cycles after the tanks are initially filled.

The Embodiment of FIG. 5

Rinse tank 26 as disclosed previously comprised a 55 gallon drum or barrel or any other suitable tank. However, it would also be suitable to form a rinse tank 26 as shown in FIG. 5. In FIG. 5, rinse tank 26 is formed by a flexible sheet of material, such as a flexible piece of plastic sheeting, which is formed to define an upwardly opening elongated cavity, generally indicated as 146. Plastic sheeting may be suitably secured or attached as by glue at 148 or the like to the treating tanks 20–25. The drain 110 may comprise a Y-shaped plastic drain made of rigid PVC material or the like. Drain 110 may simply be secured as by gluing to a bottom opening formed in the plastic sheeting material comprising the rinse tank. Thus, rinse tank 26 can be made from inexpensive and easily available materials. In such a case, rinse tank 26 is flexible and the shape thereof can obviously vary.

The Embodiment of FIG. 8

While a particularly effective means 8 for moving the articles 52 around the array 4 was shown in FIG. 1, such a moving means included the motorized or semi-automated traversing means 56. The present invention can also be adapted to a manually actuable type of apparatus as shown in FIG. 8.

In the embodiment of FIG. 8, the array of treating tanks 4 and the hoist motor 40 are substantially the same as shown in FIG. 1. However, instead of traversing means 56, a single, elongated, rigid rod 150 is attached to the hoist cable 48 closely adjacent the hook 50. Rod 150 has an outer end thereof formed with a handle or pistol grip generally indicated as 152. Pistol grip 152 has a manually actuable switch 154 which is operatively connected to the hoist motor 40. Upon actuation of switch 154, the hoist motor 40 will be operated to raise or lower the hoist cable 48. Of course, as the hoist cable 48 moves up and down it will also raise and lower the front of rod 150. However, rod 150 is suitably long such that an operator holding onto the pistol grip 152 is able to maintain control of the rod when the hoist cable 48 has been raised far enough to allow th articles 52 to clear the treating tanks.

The rinsing means 6 in this instances comprises a single shower nozzle 156 mounted on the end of rod 150 adjacent the hook 50. Shower nozzle 156 is oriented to spray the cleaning liquid outwardly to contact any articles 52 carried by the hook 50. Water supply conduit 158 runs along the length of rod 150. A switch 160 may be manually actuated to cause water to flow through the supply line 158 and out through nozzle 156.

The embodiment of FIG. 8 is particularly adaptable for small scale use. For example, the treating tanks 20–26 can comprise 55 gallon drums as noted previously which are inexpensive and easily obtained. In addition, rod 150 serves as a manually operable means for traversing the hoist cable 48 around the dimensions of the non-linear array 4. For example, whenever the hoist cable 48 is raised high enough such that the articles 52 clear the tanks, then the operator who is holding the pistol grip 152 then can simply manually push on rod 150 to move the hoist cable 148 to the phantom line position shown in FIG. 8. This does not require an undue amount of force because the weight of the article 52 is carried by the hoist motor 40 affixed to the ceiling 42. Whenever it is desired to shower or rinse the articles being treated, the apparatus can be suitably activated to bring the article 52 into the central rinse tank 26. Then the switch 160 is manually actuated to cause the shower nozzle 156 to spray the cleaning liquid onto the article 52.

Figure 9:
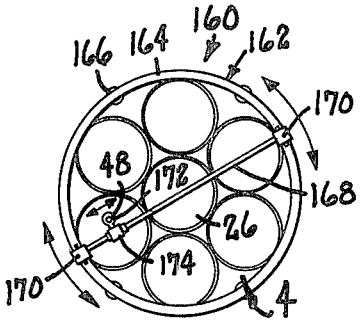
FIG. 9 is a top plan view of a third embodiment of a traversing device for moving an article around the array of treating tanks shown in the electroplating apparatus of FIG. 1.

The Embodiment of FIG. 9

FIG. 9 discloses a second embodiment for a means for moving the articles between the respective tanks 20–26 in non-linear array 4. Specifically, in moving means 160 a hoist motor (not shown) similar to that shown in FIG. 1 is contemplated for use above the central rinse tank 26. Moving means 160, however, includes a second form of a hoist cable traversing means which is indicated generally as 162. Traversing means 162 includes a circular rail 164 supported by posts 166 around the array 4. A trolley comprising an elongated bar 168 is movably mounted on rail 164 by drive motors 170 or the like which suitably engage the rail 164 (e.g., by a rack and pinion engagement). A guide ring 172 is slidably mounted on bar 168. Hoist cable 48 passes through the center of guide ring 172. Guide ring 172 is movably mounted on the bar 168 by any suitable motor 174.

The traversing means 162 shown in FIG. 9 has certain advantages over the traversing means 56 shown in FIG. 1. For example, the bar 168 of FIG. 9 can always move in the same direction around the circular rail 162 in a step-by-step manner if so desired. In addition, the guide ring 172 need only be movable over the bar 168 from a first radial position above the rinse tank 26 to a second radial position located over any of the treating tanks 20–25. Thus, the range of radial movement of the guide ring 172 on the bar 168 is decreased when compared with the range of movement which is necessary for guide ring 72 in the traversing means 56 shown in FIG. 1.

Figure 10:
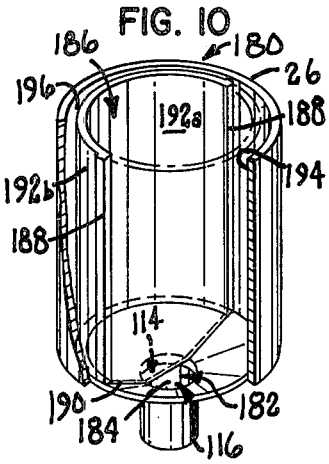
FIG. 10 is a perspective view of a second embodiment of a rinse tank for the electroplating apparatus of FIG. 1, particularly illustrating a drain means and a liner in the rinse tank for segregating the rinse tank into two sets of surfaces.

The Embodiment of FIG. 10

Referring now to FIG. 10, a second embodiment of a rinse tank and a drain and valve means therefor is generally indicated as 180. Rinse tank 180 has a circular rinse tank portion 26 substantially similar to the rinse tank 26 shown in FIG. 1. A circular drain 182 is provided in the bottom of rinse tank 126. However, drain 182 does not have a two-way valve located therein as shown in FIG. 6. Nonetheless, drain 182 has a suitable divider 184 which splits the drain into two outlet conduits 114 and 116 generally in the same manner as shown in FIG. 6.

A flexible tank liner is generally indicated as 186. Tank liner may comprise plastic or any other suitable materials and is located in tank 180. Liner 186 is shown in solid lines in FIG. 10 as having an expanded orientation and a sufficient size in which it substantially conforms to the configuration of half the rinse tank area 180. Liner 186 is attached (e.g., as by gluing) to the rinse tank 180 along its side edges 188 and bottom edges 190. However, liner 186 is substantially unattached to the remainder of the tank 180. Liner 186 can be moved or pulled by any suitable means, such as by a rope attached to the top of liner 186, to be located in first one half of the rinse tank and then in the other half as described hereafter.

As shown in solid lines in FIG. 10, liner 186 is located in a first position in which it is moved to cover the left side of the rinse tank. In this position, the liner opens the outlet conduit 116 and closes outlet conduit 114 since the liner is sufficiently sized to wholly conform to one-half of tank 180 thereby flopping down over and covering conduit 114. Liner 186 can be used in this position whenever the rinse tank 180 is being used to rinse articles where the rinse discharge is not desired to be conducted through the concentrating means of FIG. 7. The force of the rinse water coming from the shower nozzles 36 will cause the liner to maintain approximately the shape shown in FIG. 10. The rinse discharge will thus contact a first face 192*a* of the line 186 and the right side surfaces 194 of tank 180. Thus, face 192*a* and right side surfaces 194 constitute a first set of surfaces in tank 180.

However, assuming that the conduit 114 is to be opened and the conduit 116 is to be closed, then the liner can be manually pulled to a mirror-image position as shown in dotted lines in FIG. 10. In this mirror-image position, conduit 114 is now open and the liner 186 covers conduit 116 to close that conduit. The face 192*a* which was previously used to contact the rinse discharge is now located out of the way directly adjacent the right side surfaces 194 of the tank. The opposed face 192*b* of the liner and the left side surfaces 196 of the tank 180 are now in the position where they form the surfaces in rinse tank 180 which will be contacted by the rinse discharge from nozzles 36. Now, assuming that precious metals are being rinsed off in tank 180, the rinse discharge will contact only the face 192*b* of liner 186 or the left side surfaces 196 of the tank, which surfaces were previously not in contact with any of the rinse discharge when the liner was in its solid line position. Thus, the face 192*b* and the left side surfaces 196 of the tank form a second set of surfaces in the tank 180. This second set of surfaces in the tank 180 is totally segregated from the first set of surfaces such that the respective sets can be contacted by wholly separate rinse discharges.

Thus, the provision of flexible liner 186 is advantageous. It allows one to totally segregate in a single rinse tank 180 the portions of the rinse tank 180 which respectively contact various types of rinse discharges. For example, the liner in the solid line position can be used during normal rinse operations. However, when the liner is in its dotted line position, the rinse tank can then be used in precious metal operations. In these operations, none of the areas of the rinse tank 180 which are being used to conduct away the precious metal rinse discharge (i.e., face 192*b* and left side surfaces 196) have ever been contacted by any other type of rinse discharge. Thus, the precious metal rinse discharge cannot be contaminated by the first set of surfaces formed by the face 192*a* and the right side surfaces 194. This advantageous feature results even though the total area of the rinse tank can be used in both the standard and precious metal rinse discharge operations.

Various other modifications will be apparent to those skilled in the art. For example, although one rinse tank 26 has been shown in any one particular array 4, the array 4 could have more than one rinse tank 26 therein. In such a case, a separate hoist motor 40 could be provided above each rinse tank 26 and a plurality of electroplating and rinsing operations could be carried on simultaneously in the same array. As shown in FIG. 1, when the hoist cable 48 traverses from one side of the array to the other, it is able to suitably pull or bend the heating coil and the canopy slightly. However, the heating coil could be shaped so as to provide a substantially open space in the middle thereof. This open space could be suitably dimensioned such that the hoist cable could pass through the open space over the entire range of movement of the cable without ever contacting or distorting the heating coil. In addition, the position of pump 92 is not important. Pump 92 could be located directly adjacent the shower nozzles 36 if so desired in the liquid supply circuit therefor. The present invention describes an electroplating apparatus which is much simpler and less complex than those of the prior art. Thus, the electroplating apparatus of the present invention can be easily used and adapted in many small scale installations. The scope of the present invention is to be limited only by the appended claims.

What is claimed is:

1. Apparatus for electroplating articles, which comprises:

(a) a support structure which defines a floor and a ceiling;

(b) a non-linear array of treating tanks mounted on the floor, at least one of the treating tanks comprising a rinse tank;

(c) means for shower rinsing articles located in the rinse tank with rinse water; and (d) means for moving the articles between the treating tanks, the moving means including a hoist apparatus fixedly mounted above the treating tanks and having a downwardly depending hoist cable which is attachable to the articles being treated, and wherein the moving means further has means for traversing the hoist cable in two degrees of freedom over the area defined by the treating tanks to enable the hoist cable to reach each of the treating tanks.

2. Electroplating apparatus as recited in claim 1, wherein the rinse tank is located at the center of the non-linear array, and wherein the hoist apparatus is located fixedly above the rinse tank on the ceiling.

3. Electroplating apparatus as recited in claims 1 or 2, in which the traversing means comprises:

(a) a guide located above the array of treating tanks and arranged to span the array in a first longitudinal direction thereof;

(b) a carriage movably mounted on the guide for movement in the first longitudinal direction;

(c) a guide apparatus for the hoist cable; and (d) means for movably mounting the hoist cable guide apparatus on the carriage for movement in a second transverse direction, whereby the hoist cable can be moved over the entire array of treating tanks to reach each of the treating tanks by movement respectively of the carriage and of the hoist cable guide apparatus.

4. Electroplating apparatus as recited in claim 3, wherein the guide for the carriage comprises two, tranversely spaced longitudinally extending rails each of which respectively extends along one side of the array of treating tanks, and wherein the carriage includes a cross-beam member having the ends thereof movably supported on the spaced rails, at least one of the ends of the cross-beam member having a motor thereon for driving the cross-beam member along the rails.

5. Electroplating apparatus as recited in claim 4, wherein the hoist cable guide apparatus includes a guide ring slidably carried on the cross-beam member of the carriage, the guide ring extending outwardly from the cross-beam member to allow the hoist cable to pass therethrough, and further including means for moving the guide ring relative to the cross-beam member.

6. Electroplating apparatus as recited in claim 1, wherein the means for shower rinsing the articles includes a hot water rinse.

7. Electroplating apparatus as recited in claim 1, in which the traversing means comprises;

(a) a guide rod fixed at one end to the hoist cable and extending therefrom to one side of the array; and (b) a handle fixed to the other end of the guide rod which can be grasped by an operator to manually move the hoist cable around the array.

8. Electroplating apparatus as recited in claim 7, wherein the means for shower rinsing the articles includes at least one shower rinse nozzle located on the end of the guide rod adjacent the hoist cable, and wherein the guide rod has means for conducting water to the shower nozzle and the handle has a switch means for controlling water flow to the shower nozzle.

9. Electroplating apparatus as recited in claim 7, wherein the handle has a switch means located thereon for manual actuation by the operator for controlling operation of the hoist apparatus.

10. Electroplating apparatus as recited in claims 1 or 6, further including:

(a) means for heating at least some of the treating tanks;

(b) means for conserving waste heat given off by the heated treating tanks; and (c) means for heating the rinse water used in the shower rinsing means from the waste heat saved by the conserving means.

11. Electroplating apparatus as recited in claim 10, in which the conserving means comprises a canopy made of a heat insulating material surrounding the array, and wherein a water supply line for the shower rinsing means is located inside of the canopy in a heat exchange relationship with the waste heat conserved therein.

12. Electroplating apparatus as recited in claim 1, wherein the rinse tank is defined by a sheet of flexible material shaped into a upwardly opening cavity and held by adjacent ones of the treating tanks.

13. Electroplating apparatus as recited in claims 1 or 12, wherein the rinse tank further includes a drain for draining away the rinse water, the drain further having a vlave for conducting the rinse water either to a disposal or to means for concentrating contaminants contained in the rinse water.

14. Electroplating apparatus as recited in claim 13, wherein the concentrating means comprises:

(a) a plurality of tanks;

(b) valve means for dividing the discharged rinse water into a plurality of rinse discharge portions equal to the number of tanks and for conducting these portions to each of the tanks in a consecutive manner;

(c) means for dividing the rinse water used in a future rinse operation into a plurality of segments equal to the number of tanks, the dividing means including means for drawing the rinse water segments from the tanks in a consecutive manner; and (d) means for controlling the operation of the valve means and the dividing means such that each rinse water segment is taken from a given tank substantially simultaneously as the rinse discharge portion is being conducted to the given tank, whereby the concentration of the contaminants contained in the tanks is increased from one rinse operation to the next.

15. Electroplating apparatus as recited in claim 14, wherein the tanks are arranged in a cascade fashion with the last tank in the cascade comprising the tank which receives the first rinse discharge portion in a rinsing operation.

16. Electroplating apparatus as recited in claim 15, wherein the dividing means further includes means for introducing pure water as a final portion of the last rinse water segment, thereby causing the tanks in the cascade arrangement to overflow into one another.

17. Electroplating apparatus as recited in claim 1, wherein the rinse tank further includes a drain for draining away the rinse water, the drain having two outlet conduits for conducting the rinse water to two separate discharge points, and further including means located in the rinse tank for forming two, segregated sets of surfaces each of which respectively communicates with one outlet conduit as the other outlet conduit is simultaneously closed, whereby the rinse water drained through one outlet conduit always contacts the same set of surfaces to lessen contamination of the rinse water drained through the outlet conduit.

18. An improved apparatus for electroplating a plurality of articles, which comprises:

(a) an array of treating tanks at least one of which is a rinse tank;

(b) means for heating at least some of the treating tanks;

(c) means for shower rinsing articles contained in the rinse tank with a cleaning fluid;

(d) means for moving the articles between the treating tanks; and (e) means for conserving waste heat given off by the heating tanks during an electroplating operation, the conserving means being located in a heat exchange relationship with a cleaning fluid supply line for the rinsing means, whereby the cleaning fluid sprayed thereby will be heated.

19. An improved electroplating apparatus as recited in claim 18, wherein the conserving means comprises a heat insulating canopy surrounding the array of treating tanks, the canopy having an upper portion supported in a spaced manner above the treating tanks to define an upper chamber therein, and wherein the supply line is located in this chamber in a heat exchange relationship.

20. An improved electroplating apparatus as recited in claim 19, in which the supply line is coiled to increase the surface area thereof located in the chamber, and wherein the coiled portion of the supply line is supported independently of the canopy.

* * * * *